US006920676B2

(12) United States Patent
Fitton et al.

(10) Patent No.: US 6,920,676 B2
(45) Date of Patent: Jul. 26, 2005

(54) METHOD OF MANUFACTURING A LAUNDRY APPLIANCE

(75) Inventors: Nicholas Gerald Fitton, Swindon (GB); Iain Roberts, Chicago, IL (US)

(73) Assignee: Dyson Limited, Wiltshire (GB)

( * ) Notice: Subject to any disclaimer, the term of this patent is extended or adjusted under 35 U.S.C. 154(b) by 63 days.

(21) Appl. No.: 10/363,223

(22) PCT Filed: Sep. 12, 2001

(86) PCT No.: PCT/GB01/04064

§ 371 (c)(1),
(2), (4) Date: Jul. 14, 2003

(87) PCT Pub. No.: WO02/22937

PCT Pub. Date: Mar. 21, 2002

(65) Prior Publication Data

US 2004/0045150 A1 Mar. 11, 2004

(30) Foreign Application Priority Data

Sep. 16, 2000 (GB) ..... 0022804

(51) Int. Cl.[7] ..... B21D 39/03
(52) U.S. Cl. ..... 29/428
(58) Field of Search ..... 29/428, 453, 462, 29/469; 510/276; 68/3 R; 312/265.6; 220/835; 34/603

(56) References Cited

U.S. PATENT DOCUMENTS 4,900,109 A 2/1990 Boston et al.
5,571,276 A 11/1996 Kobos et al.
5,584,549 A 12/1996 Lybarger et al.
5,806,942 A 9/1998 Jenkins, Jr. et al.
5,881,576 A 3/1999 Davies, Jr.

FOREIGN PATENT DOCUMENTS

EP 0 104 497 A2 4/1984
EP 0 208 334 A2 1/1987
EP 0 588 100 A1 3/1994

*Primary Examiner*—John C. Hong
(74) *Attorney, Agent, or Firm*—Morrison & Foerster LLP

(57) ABSTRACT

The invention provides a method of manufacturing a laundry appliance (10) which comprises the steps of: a) manufacturing and assembling, in a first location, a laundry appliance (10) comprising an outer casing (12) in which is mounted a means for washing and/or drying laundry (102), the outer casing (12) including a fascia (20), the fascia (20) being removable from the outer casing (12); b) transporting the laundry appliance (10) to a second location; c) manufacturing at least one alternative fascia attachable to the outer casing (12) of the laundry appliance (10), the or each alternative fascia differing from the fascia (20) by colour material or finish; d) transporting the or each alternative fascia to the second location; e) selecting the or an alternative fascia; and f) replacing the fascia (20) with the selected alternative fascia so as to change the final appearance of the laundry appliance (10). The invention provides a further method of manufacturing a laundry appliance (10).

14 Claims, 10 Drawing Sheets

METHOD OF MANUFACTURING A LAUNDRY APPLIANCE

The invention relates to a method of manufacturing a laundry appliance. The invention relates to a method of manufacturing a laundry appliance such as a washing machine, a washer-dryer machine or a tumble dryer.

Laundry appliances are bulky items which take up a large amount of storage space prior to sale. In the event that a particular appliance is offered in a variety of finishes, the retailer has to choose either to provide sufficient space so as to be able to store a large number of appliances to meet a variety of customer demands or, alternatively, to store only a small number of appliances and order any appliances not immediately available on demand. This second alternative can be frustrating for customers, as they may have to wait a considerable time before receiving the selected goods. If the individual customer is not prepared to tolerate the delay, the retailer may lose a sale.

A washing machine generally consists of an outer casing in which is mounted a water-tight interior container. An opening is provided, either in the front of the outer casing (front-loading machine) or in the top of the outer casing (top-loading machine), to allow laundry to be introduced to and removed from the machine. Tumble dryers and washer-dryers are similar to washing machines in their overall structure, having an outer casing and an interior drum rotatably mounted therein. A door is provided on the outer casing to allow access to the drum.

The outer casing generally comprises four parts; two side walls, a top cover and a front face. The base and the rear of the machine are not normally visible and do not generally need to be concealed by the outer casing. The parts forming the outer casing are commonly made from metal, in particular, metal which has a neutral finish on its exterior surface (i.e. white or beige paint). The parts are fixed to the appliance during the final stages of manufacture. In general, most laundry appliances have this neutral physical appearance which gives the consumer little choice in the appearance of an appliance for use in the home. Manufacturers of kitchen units have attempted to overcome this problem for other household appliances, for example refrigerators, freezers and dishwashers, by providing fascias for the appliances. These fascias are generally affixed to the front of the appliance, sometimes in place of the front face of the outer casing, so as to give the appliance the same finish or appearance as other kitchen units. However, this method is not normally applied to laundry appliances, in particular front-loading machines, because of the door present in the front face.

It is an object of the present invention to provide a method of manufacturing a laundry appliance which more readily meets the needs of a variety of customers. It is a further object of the invention to provide a method of manufacturing a laundry appliance which allows the laundry appliance to be stored conveniently, occupying minimum space whilst providing enhanced variety of choice to the consumer.

The invention provides a method of manufacturing a laundry appliance comprising the steps of:

a) manufacturing and assembling, in a first location, a laundry appliance comprising an outer casing in which is mounted a means for washing and/or drying laundry, the outer casing including a fascia, the fascia being removable from the outer casing;

b) transporting the laundry appliance to a second location;

c) manufacturing at least one alternative fascia attachable to the outer casing of the laundry appliance, the or each alternative fascia differing from the fascia by colour, material or finish;

d) transporting the or each alternative fascia to the second location;

e) selecting the or an alternative fascia; and f) replacing the fascia with the selected alternative fascia so as to change the final appearance of the laundry appliance.

The invention further provides a method of manufacturing a laundry appliance comprising the steps of:

a) manufacturing and assembling, in a first location, a laundry appliance comprising an outer casing in which is mounted a means for washing and/or drying laundry, the outer casing comprising means for receiving a fascia;

b) transporting the laundry appliance to a second location;

c) manufacturing a plurality of fascias attachable to the outer casing of the laundry appliance, the fascias differing from one another by colour, material or finish;

d) transporting the fascias to the second location;

e) selecting a fascia; and f) attaching the fascia to the outer casing so as to select the final appearance of the laundry appliance in the second location.

Alternatively, steps (a) and (c) occur before step (d). Alternatively, steps (a) and (b) occur before step (c). Alternatively, steps (a) and (b) occur before step (d). Alternatively, steps (c) and (d) occur before step (a). Alternatively, steps (c) and (d) occur before step (b). Alternatively, steps (a) and (c) occur before step (b). Optionally, steps (b) and (d) occur simultaneously. Alternatively, step (c) takes place at a location different from the first and second location. Preferably, step (c) takes place at the first location.

Preferably, the first location is a manufacturing plant. More preferably, the second location is a storage facility or retail outlet.

Preferably, at least three alternative fascias are provided. Optionally, at least five alternative fascias are provided. Alternatively, at least seven alternative fascias are provided.

The appearance of each appliance manufactured can be altered to suit any individual customer's preference. This avoids the need for large stocks of all available appearances to be maintained either at the manufacturer's premises or at the retailer's premises. The manufacturer only needs to build a basic appliance, with or without a fascia, and a range of alternative fascias. The basic appliance and the range of alternative fascias are offered to the customer either at a retail outlet, via an internet shopping site or through a brochure. The customer chooses their preferred fascia, whether that is, for example, a wood-finished fascia which fits in with the decor of the kitchen, a transparent fascia which allows the customer to see the main components of the appliance or some other finish. The retailer attaches the chosen fascia to the appliance for immediate delivery to the customer.

Further and advantageous features of the invention are set out in the subsidiary claims.

Embodiments of the invention will now be described, by way of example only, with reference to the accompanying drawings, in which.

Figure 1:
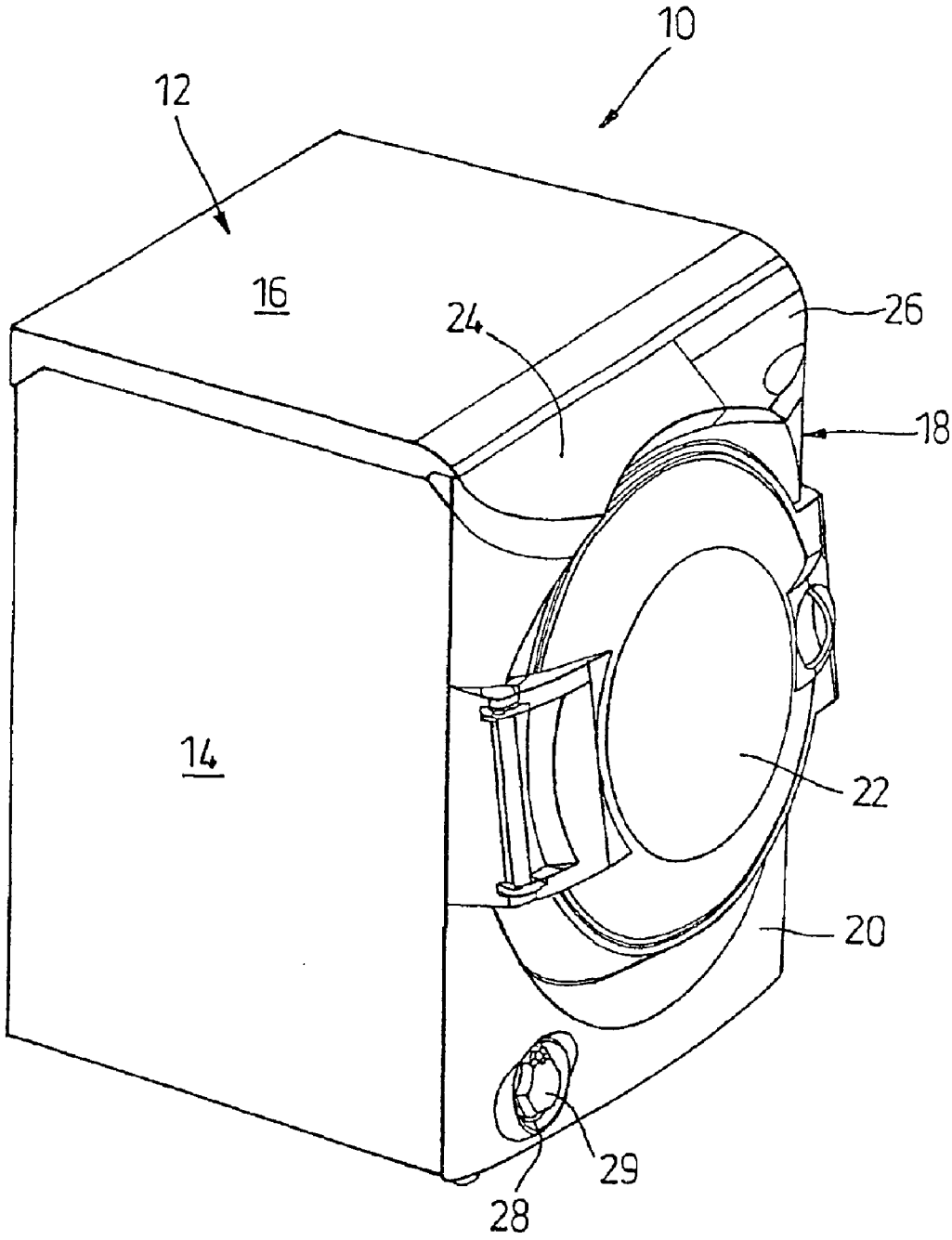
FIG. 1 is a perspective view of a washing machine according to the invention.
Figure 2:
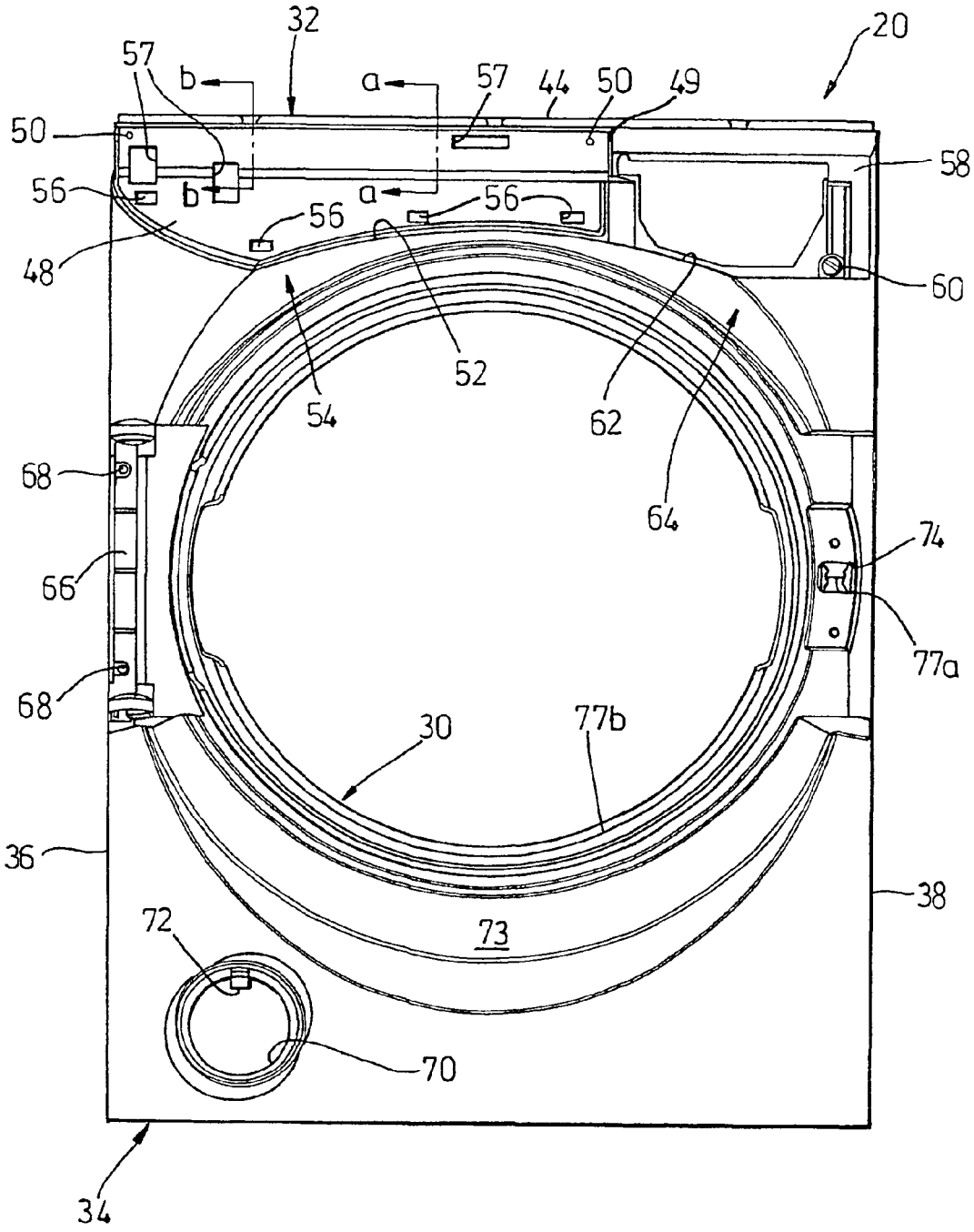
FIG. 2 is a front view of the fascia forming part of the washing machine shown in FIG. 1.
Figure 3A:
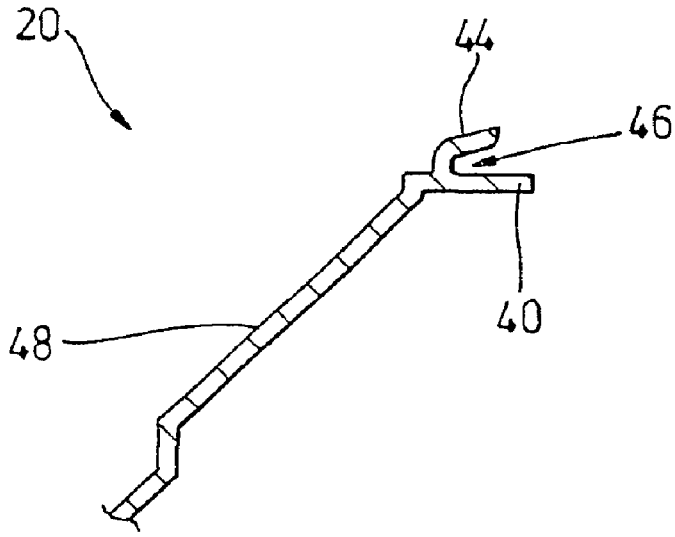
Figure 3B:
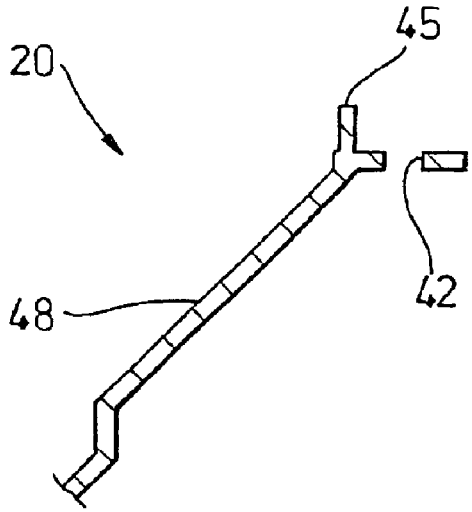
Figure 4:
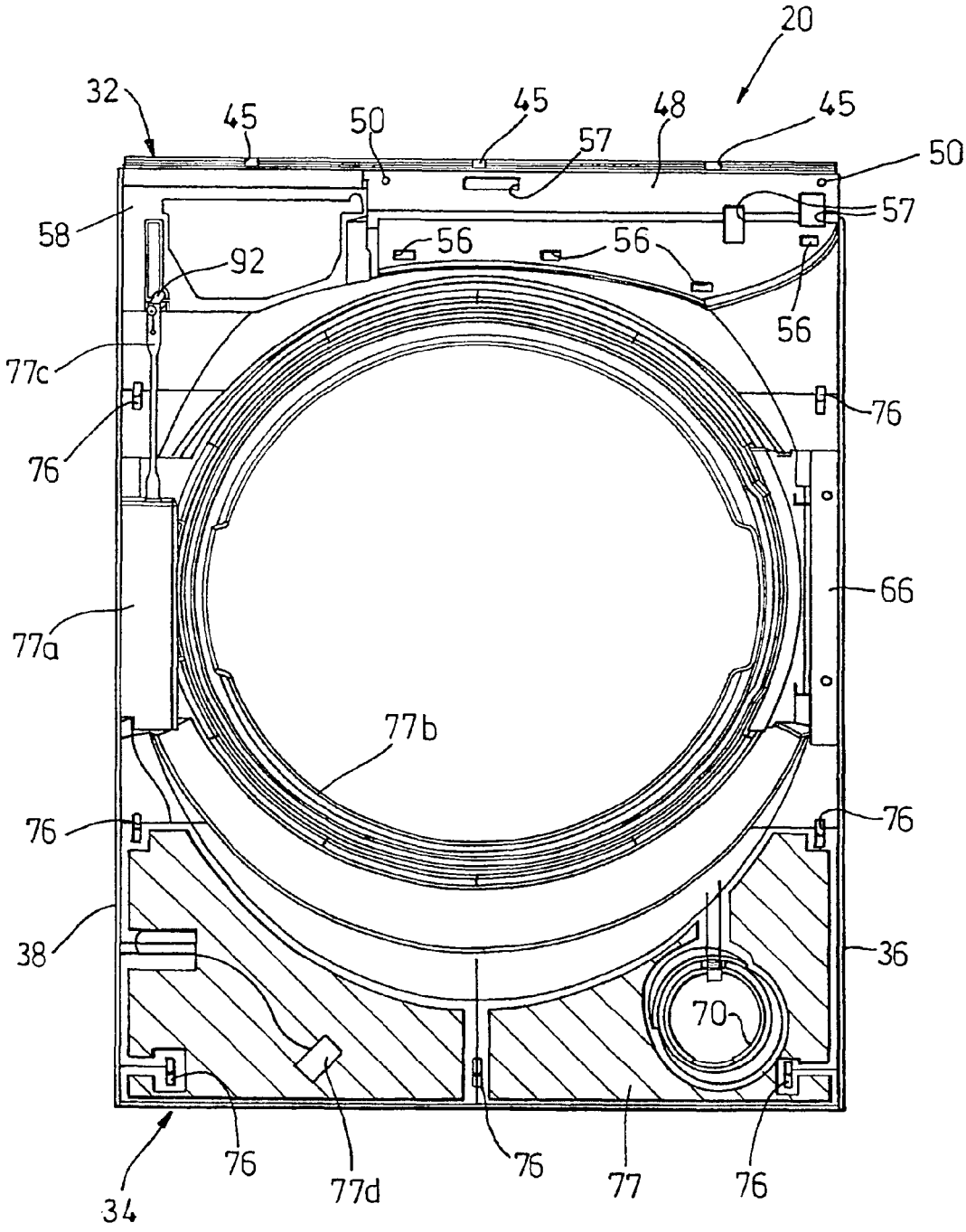
Figure 5:
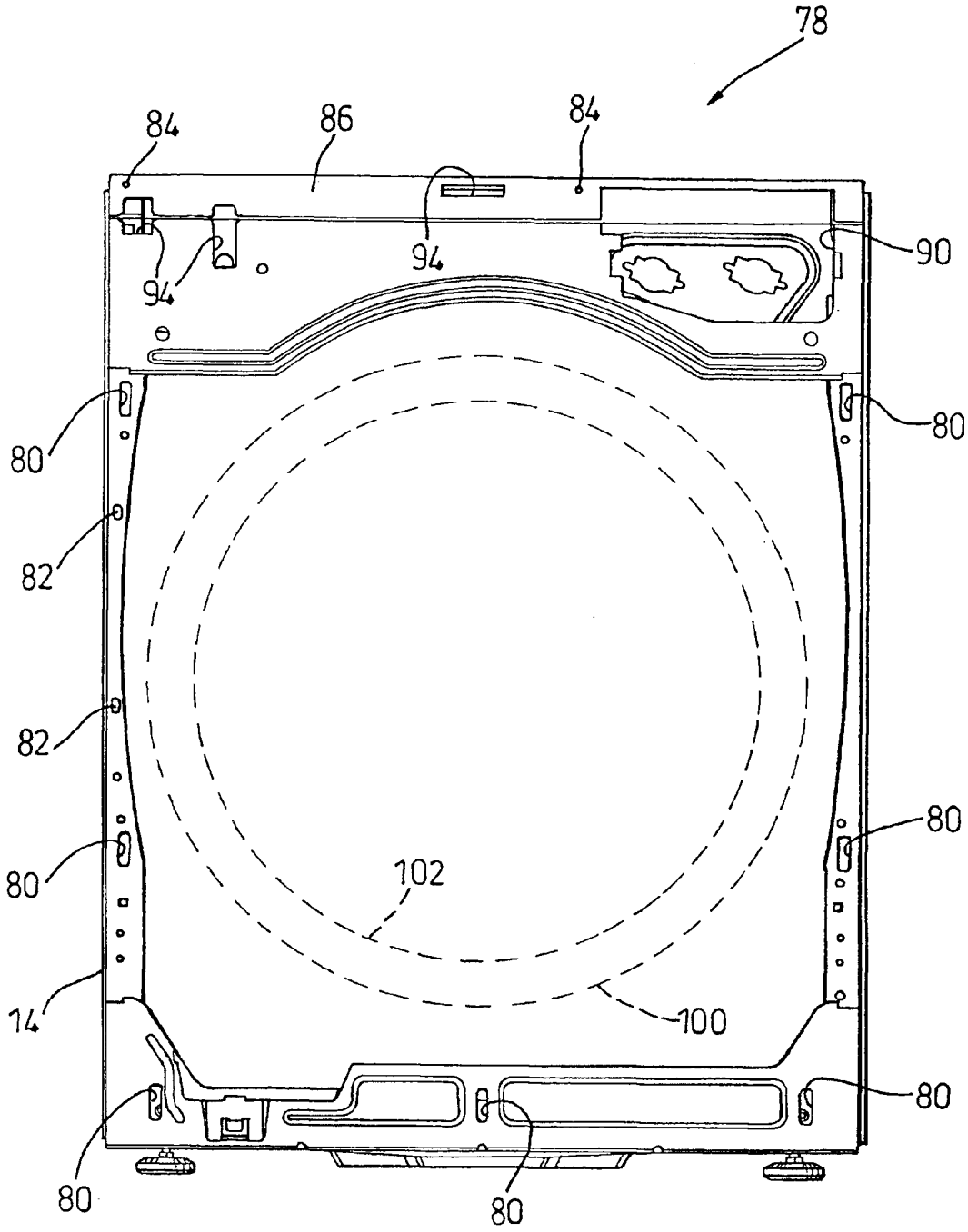
Figure 6:
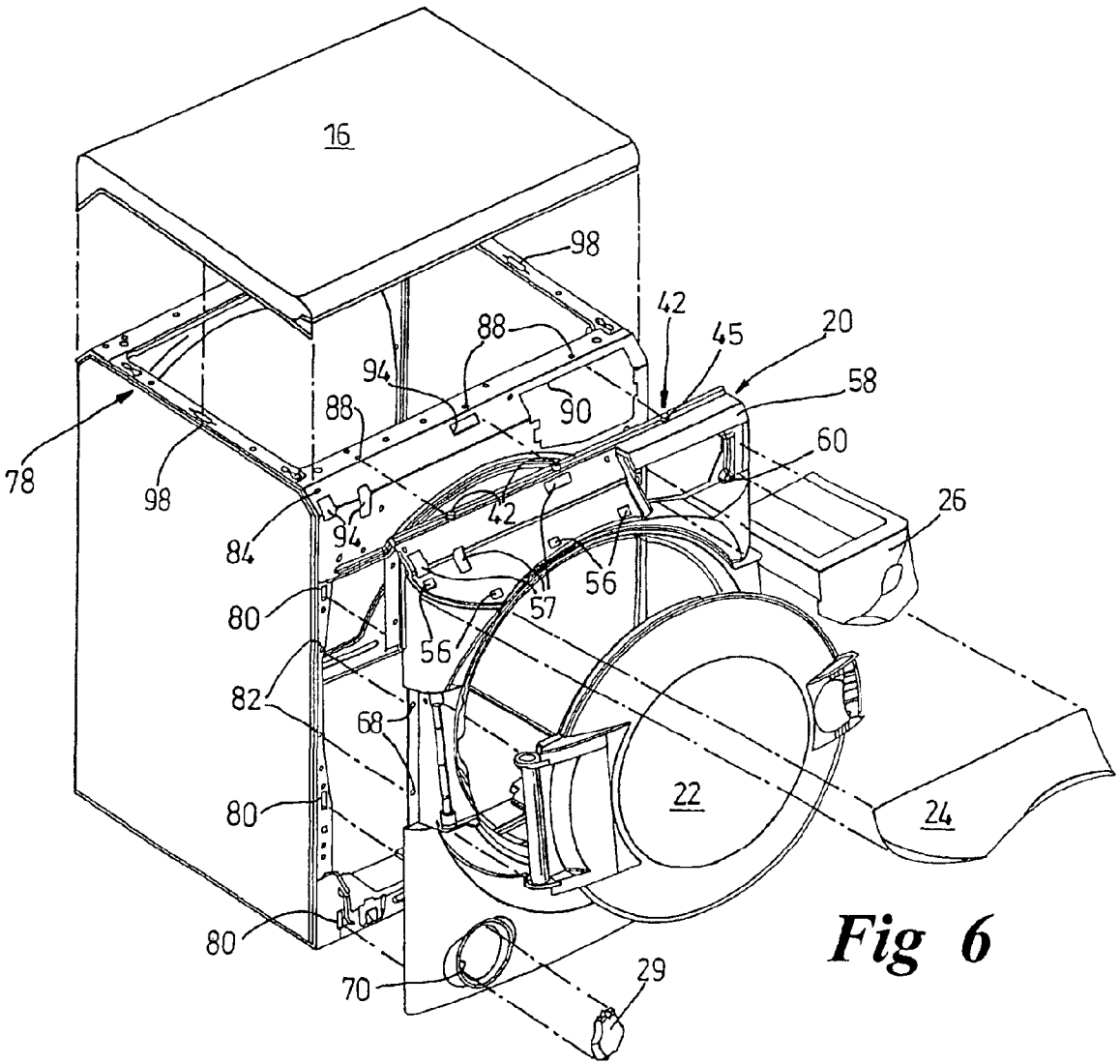
Figure 7:
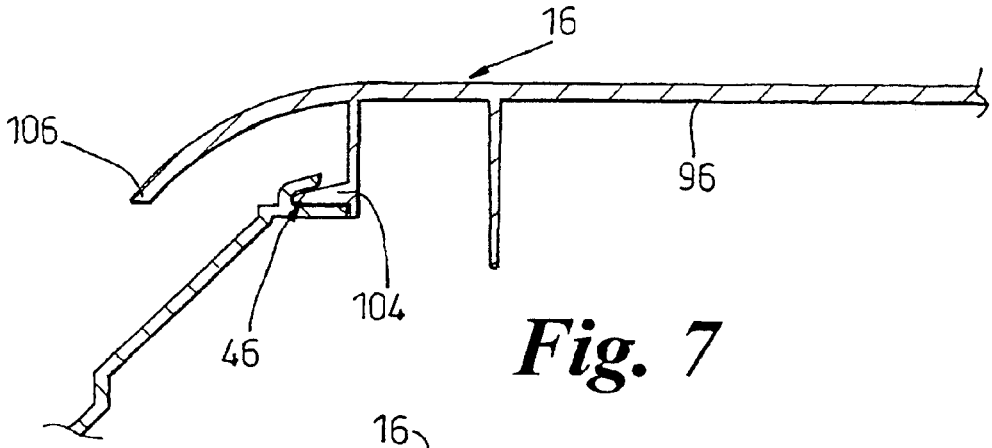
Figure 8:
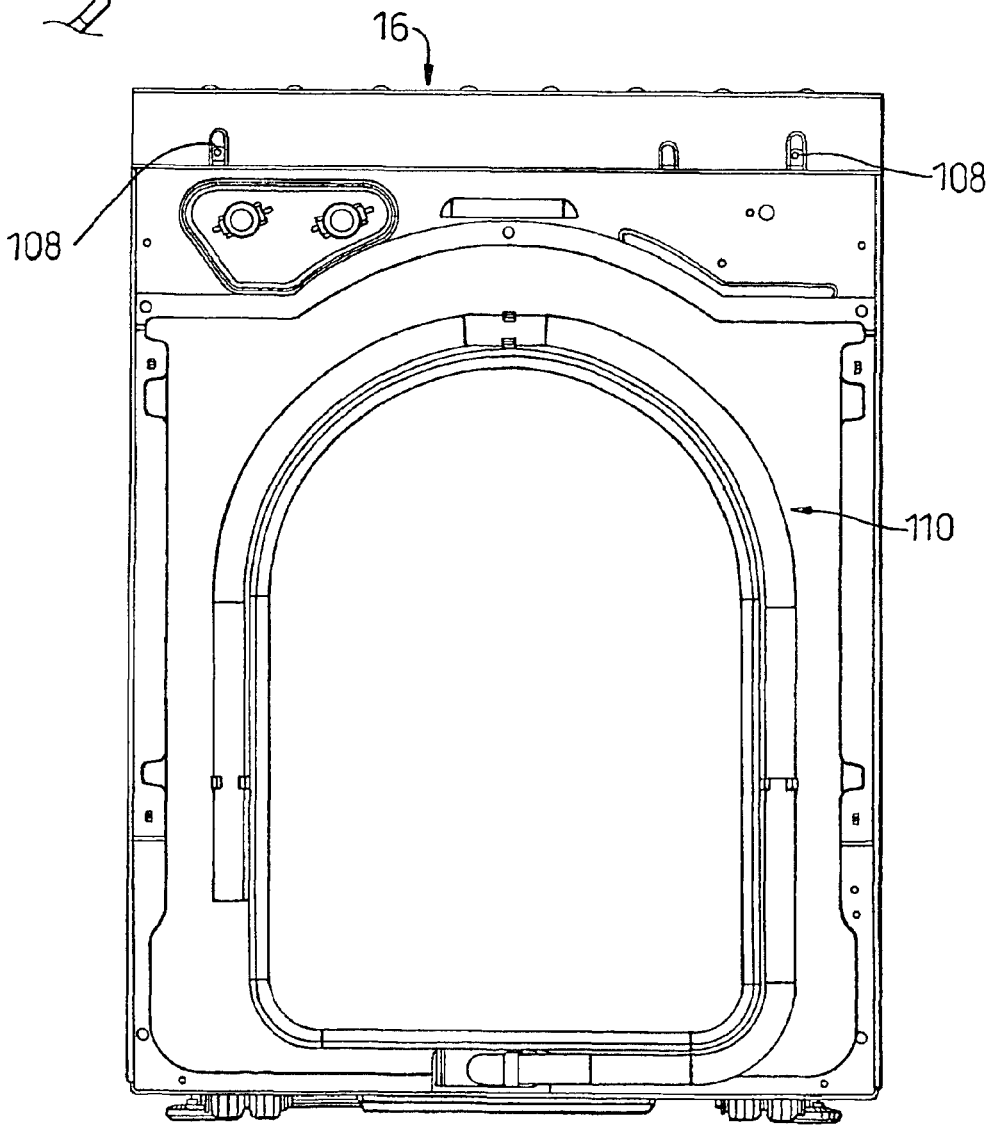
Figure 9:
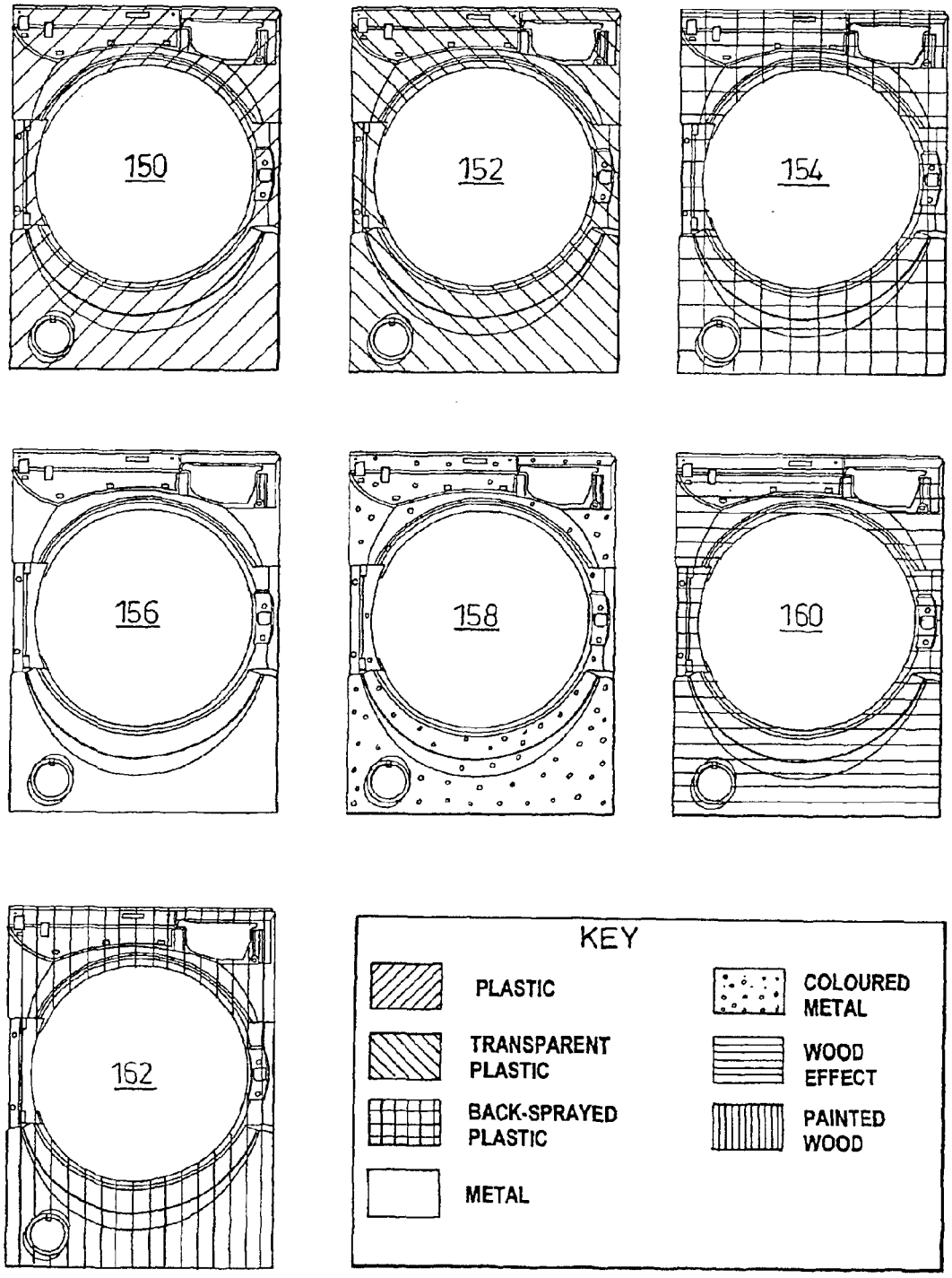
Figure 10:
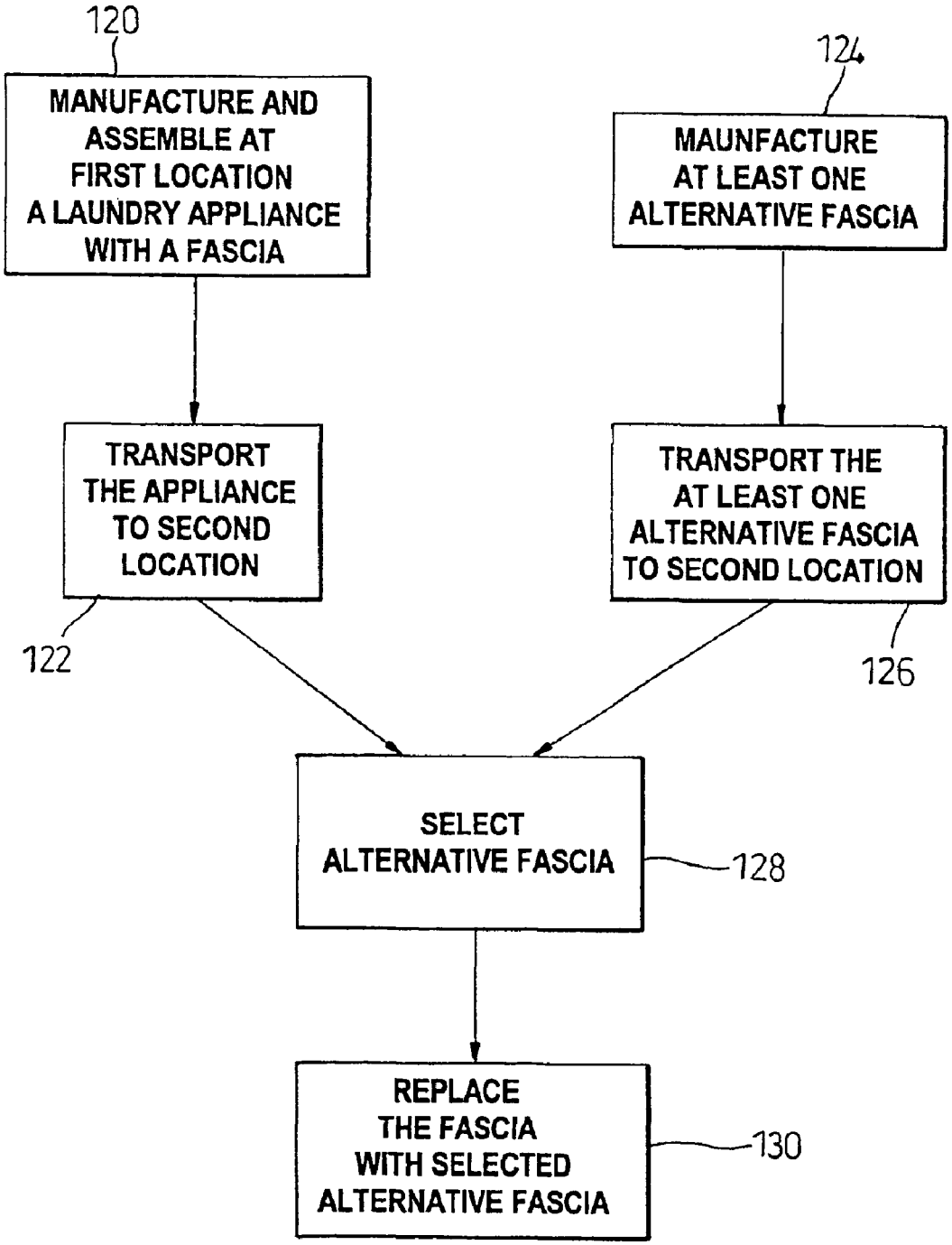
Figure 11:
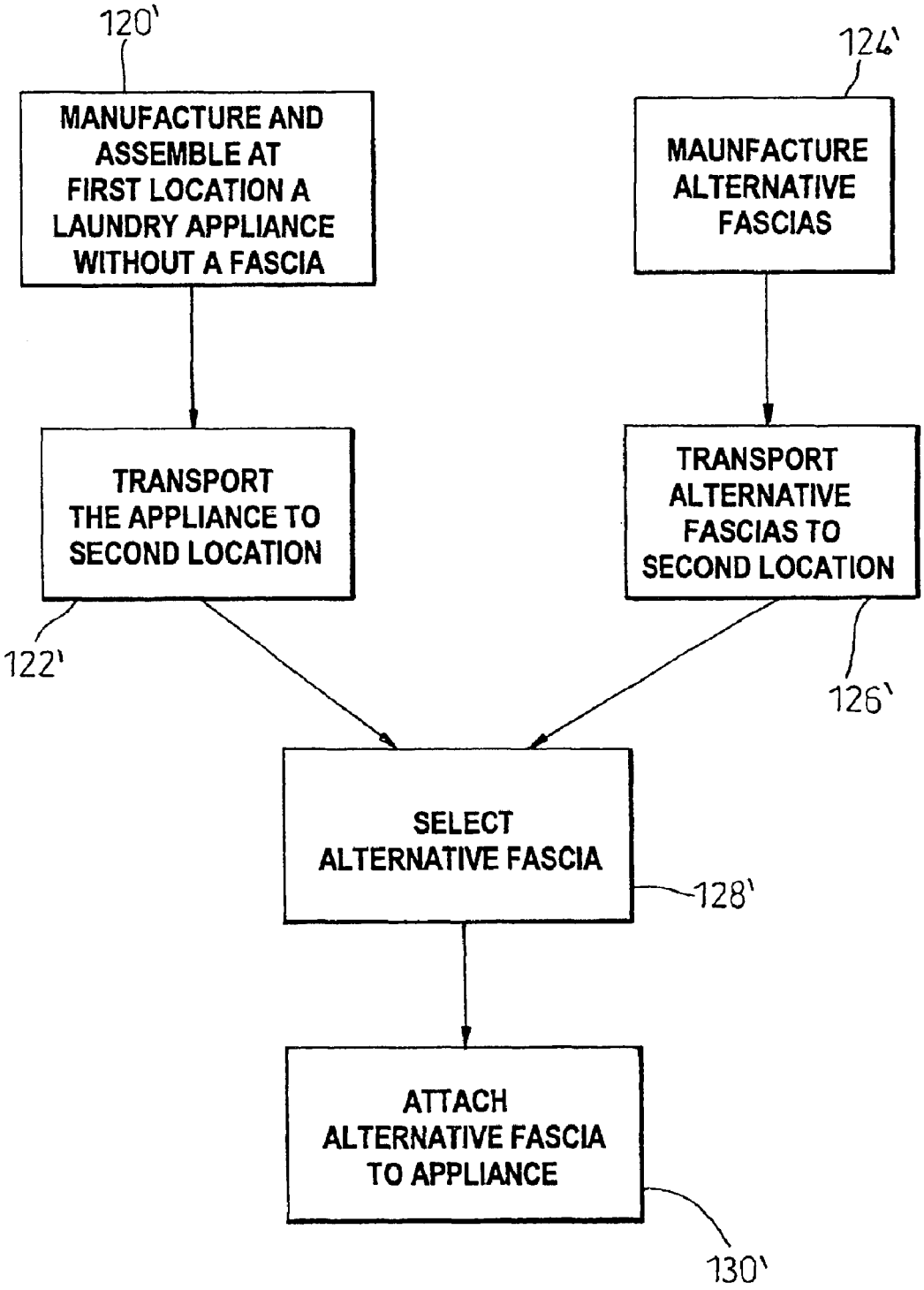

FIG. 3*a* is a sectional view taken along line a—a of FIG. 2;

FIG. 3*b* is a sectional view taken along line b—b of FIG. 2;

FIG. 4 is a rear view of the fascia shown in FIG. 2;

FIG. 5 is a front view of the washing machine of FIG. 1 without the fascia attached;

FIG. 6 is an exploded view of the washing machine of FIG. 1;

FIG. 7 is a sectional side view of an upper front part of the washing machine of FIG. 1 shown on an enlarged scale;

FIG. 8 is a rear view of the washing machine of FIG. 1;

FIG. 9 includes the front views of seven alternative fascias;

FIG. 10 is block flow diagram illustrating a method according to the invention; and FIG. 11 is a block flow diagram illustrating an alternative method according to the invention.

Referring initially to FIG. 1, the laundry appliance shown therein is a washing machine 10. The washing machine 10 has an outer casing 12 comprising side walls 14, a top cover 16 and a front face 18. The base and rear of the washing machine 10 are hidden from view in normal use. The outer casing 12 can be dimensioned so as to fit within a standard appliance space as is commonly provided in European kitchens and utility rooms. However, the dimensions of the washing machine 10 do not form part of the present invention and can be varied to suit requirements.

The front face 18 includes a fascia 20, a door 22, a control panel 24, a soap tray drawer 26 and a coin trap 28. The control panel 24 houses various control buttons or other devices for appropriate programming and operation of the washing machine 10. The soap tray drawer 26 allows access to a soap tray for receiving detergent. The coin trap 28 provides access to a cavity for collecting large foreign objects inadvertently introduced to the washing machine 10. It is to be understood that the position and operation of the control panel 24, the soap tray drawer 26 and the coin trap 28 do not form part of the present invention.

In order to function as a washing machine, an interior container or tub 100 (shown in dotted lines in FIG. 5) is mounted inside the outer casing 12 in a known manner. A cylindrical drum 102 is mounted inside the tub 100, with a motor (not shown) being provided so as to cause the drum 102 to rotate. Means (not shown) are provided for introducing water to the tub 100 and also for draining water from the tub 100 and pumping it to a water outlet. These features are well known in the art and, for this reason, are not shown in the Figures or described any further here.

FIGS. 2, 3*a*, 3*b* and 4 show the fascia 20 of the washing machine 10. The fascia 20 is generally rectangular in front view having an upper edge 32, a lower edge 34 and side walls 36, 38. The fascia 20 has a generally circular opening 30 located centrally thereof. The opening 30 allows access to the drum 102 of the washing machine 10 and is closed by the door 22. The upper edge 32 has a first flange 40 extending generally horizontally and towards the rear of the washing machine 10. The first flange 40 has a plurality of equi-spaced holes 42 for receiving screws. In the embodiment shown, there are three holes 42, each having a diameter of 4 mm. A second flange 44 extends generally parallel to the first flange 40 but spaced therefrom so as to form a channel 46 between the first flange 40 and the second flange 44 as shown in FIG. 3*a*. The second flange 44 is discontinued in the region of each hole 42 to allow access thereto from above. A wall 45 is located in this region so as to partially surround each of the holes 42 as shown in FIGS. 3*b* and 6.

As shown in FIG. 2, the area of the fascia 20 adjacent the upper edge 32 comprises a first portion 48 and a second portion 58. The first portion 48 is shaped and configured to receive the control panel 24. The second portion 58 is shaped and configured to accommodate the soap tray drawer 26. An upstanding wall 49 lies between the first and second portions 48, 58. The first portion 48 is inclined away from the upper edge 32 so that the control panel 24 received thereon is presented to the user of the washing machine 10 at an inclined angle. A lower edge 52 of the first portion 48 has an arcuate shape which generally follows the perimeter of the opening 30. A shaped portion 54, which is inclined to adjacent portions, lies between the lower edge 52 and the opening 30. Holes 50 are located at an upper end of the first portion 48. Two holes 50 are shown in the embodiment, each having a diameter of 4 mm. The holes 50 are intended to receive screws or other fixing means to secure the control panel 24 and the fascia 20 to the washing machine 10 as will be described below. Apertures 56 are located in the first portion 48 adjacent the lower edge 52. The apertures 56 are generally rectangular in cross section and are configured to receive hooks (not shown) located on the inner surface of the control panel 24. Openings 57 are located in the first portion 48. The openings 57 are generally rectangular in cross section and are shaped and configured to receive electrical wires which connect the control panel 24 to the control system of the washing machine 10. A lower edge 62 of the second portion 58 has an arcuate shape which generally follows the perimeter of the opening 30. A shaped portion 64, which is inclined to adjacent portions, lies between the lower edge 62 and the opening 30. A hole 60 is provided in the second portion 58 adjacent the side wall 38 to accommodate an interlock release lever 77*c* for the door locking mechanism.

Side walls 36, 38 extend between the upper edge 32 and the lower edge 34. A hinge recess 66 is integrally moulded in the fascia 20 adjacent the side wall 36. The recess 66 has holes 68 for inserting screws to secure the fascia 20 to the washing machine 10. The recess 66 is adapted to receive the door 22 in a hinging manner. The assembly of the door onto the fascia 20 is more fully described in co-pending application GB 00 06500.3. The side wall 38 has a cavity 74 for receiving and accommodating the interlock assembly 77*a* as shown in FIGS. 2 and 4. The cavity 74 is located diametrically opposite the cavity 66.

An opening 70 is located in the fascia 20 adjacent the lower edge 34 and adjacent the side wall 36. The opening 70 is circular and is dimensioned so that, when the fascia 20 is fitted to the washing machine 10, the opening 70 surrounds the coin trap 28. A tab 72 projects downwardly from the opening 70 to engage with the coin trap 28 in a predetermined position. A shaped portion 73, which is inclined to adjacent portions, is provided in the fascia 20 immediately below the opening 30.

FIG. 4 shows the inner surface of the fascia 20. Hooks 76 are integrally moulded on the inner surface for locating and securing the fascia 20 on the front of the washing machine 10. In the embodiment shown, seven hooks 76 are provided; three pairs being located in horizontally opposed pairs adjacent the side walls 36,38 and a single hook 76 located centrally adjacent the lower edge 34. It will be appreciated that alternative securing means may be provided, for example, screws. Sound absorbing material 77 (shown as hatched areas in FIG. 4) is packed behind the inner surface of the fascia 20 in the area adjacent the lower edge 34. The sound absorbing material 77 is shaped and configured to be push-fitted into recesses formed by the shapings of the fascia 20. The sound absorbing material 77 may also be packed behind the side walls 14 and on the inner surface of the top cover 16. A peg 92 is located adjacent the second portion 58 for securing an interlock release lever 77*c*. An interlock assembly 77*a* and a fascia seal 77*b* are also mounted on the inner surface of the fascia 20.

The front of the frame 78 of the washing machine 10 is shown in FIGS. 5 and 6. The frame 78 is generally rectangular in front view and has slots 80, located around the perimeter thereof, which co-operate with the hooks 76. A pair of screw holes 82 is located on the side wall 14. Two further screw holes 84 are located on an upper part 86 of the frame 78. Openings 94 are also located in the upper part 86. Three equi-spaced holes 88 are located on an edge of the upper part 86 to co-operate with the holes 42 of the fascia 20 as shown in FIG. 6. A cavity 90 is located in the upper part 86 to provide access for the soap tray drawer 26.

FIG. 6 illustrates the assembly of the fascia 20 on the frame 78. In order to assemble the fascia 20 on the frame 78, the fascia 20 is held against the frame 78 so that the hooks 76 are aligned with the slots 80 and the opening 70 is aligned with the coin trap 28. In this position, a connector 77*d* from the interlock assembly 77*a* mounted on the fascia 20 is connected to a connector in the washing machine 10. The interlock release lever 77*c* is fitted to peg 92. The fascia 20 is then positioned relative to the frame 78 so that the hooks 76 can pass through the slots 80 and the coin trap 28 can pass through the opening 70. The fascia 20 is pressed towards the frame 78 and downwardly with respect to the frame 78 so that the hooks 76 pass through the slots 80 and seat therein. The fascia 20 is then secured in the position in which the holes 42 are aligned with the holes 88, the openings 57 are aligned with the openings 94, the second portion 58 is aligned with the cavity 90, and the holes 68 are aligned with the holes 82. Screws are passed through the holes 42 of the fascia 20 and the holes 88 of the frame 78 so as to further secure the fascia on the frame 78. Screws are also passed through the holes 68 of the fascia 20 and the holes 82 of the frame 78. The soap tray drawer 26 is push-fitted into the cavity 90. A lip (not shown) on the soap tray drawer 26 prevents the drawer 26 from being readily pulled out of position. The tab 72 engages with the coin trap 28 and a cover 29 is screwed onto the coin trap 28. The control panel 24 is pressed against the first portion 48. Hooks (not shown) on the inner surface of the control panel 24 pass through the apertures 56. Electrical cables from the control system of the washing machine 10 pass through the openings 94, 57 and connect to electrical cables or connectors of the control panel 24. The control panel 24 is secured to the fascia 20 by screws which pass through the holes 50 and through the holes 84 in the frame 78. The door 22 is mounted in the hinge recess 66. The top cover 16 is positioned relative to the frame 78 so that hooks (not shown) on the inner surface 96 of the top cover 16 pass through slots 98 on the upper surface of the frame 78. The top cover 16 is pushed forwards on the frame 78 such that tongues 104 engage with the channel 46 as shown in FIG. 7. The top cover 16 is positioned so that the front surface 106 of the top cover 16 covers the holes 50 and the upper portion of the control panel 24. The top cover 16 is secured to the washing machine 10 by screws 108 located on the rear surface 110 thereof as shown in FIG. 8.

If it is required to remove or replace the fascia 20, the screws 108 on the rear surface 110 of are unscrewed. The top cover 16 is pushed towards the rear surface 110 so that the tongues 104 disengage from the channel 46. The top cover 16 is lifted from the frame 78 so that the hooks are released from the slots 98 (not shown). The door 22 is removed from the hinge recess 66. The screws in the holes 50, 84 are removed. The electrical cables from the control system of the washing machine 10 are disconnected from the electrical cables or connectors of the control panel 24. The control panel 24 is lifted away from the fascia 20 so that the hooks on the inner surface of the control panel 24 are released from the apertures 56. The cover 29 is unscrewed from the coin trap 28 and the soap tray drawer 26 is removed. The screws through the holes 68, 82 are removed. The screws through the holes 42, 88 are removed. The fascia 20 is pushed upwardly so as to disengage the hooks 76 from the slots 80. The interlock release lever 77*c* is removed from the peg 92. The connector 77*d* from the interlock assembly 77*a* is disconnected from the connector in the washing machine 10. The fascia 20 is lifted away from the frame 78.

A number of alternative fascias are shown in FIG. 8. Seven alternative fascias are shown but it will be appreciated that there may be more than seven alternative fascias available for selection. A key is provided in FIG. 8 to indicate the material and appearance of the alternative fascias. Fascia 150 is moulded from a plastics material, for example, polycarbonate. The plastics material may be manufactured in a number of alternative colours. Optionally, the plastics material can be transparent as represented by fascia 152, allowing the customer to see the inner components of the washing machine 10. The transparent fascia 152 may be non-coloured transparent plastic or may be coloured transparent plastic. Further, the transparent plastic may be back-sprayed as represented by fascia 154. Back-spraying is a technique whereby the inner surface of the fascia 154 is sprayed with suitable paint. Variations of colour for this fascia 154 are possible. A variety of different coloured transparent fascias may be provided which can be back-sprayed using a variety of different paints. For example, a transparent purple fascia may be back-sprayed with silver paint. The process of back-spraying gives the aesthetically pleasing effect of depth to the fascia 154. Fascia 156 and fascia 158 are metal fascias. Fascia 156 has a neutral finish, for example, painted white or beige. Fascia 158 is not neutral and can be manufactured in a variety of different colours, for example, painted silver to give a chrome-like finish. Fascia 160 and fascia 162 are made from wood or a material giving a wood effect. Fascia 160 gives the appearance of natural wood which can be varnished or tinted. Fascia 162 is wood which is painted, stained or colour washed to match other wooden kitchen units. The fascias may be supplied to the retailer in sets of three alternative fascias, five alternative fascias or seven alternative fascias.

FIGS. 9 and 10 illustrate methods of manufacturing the washing machine 10 of the present invention. FIG. 9 illustrates a method of manufacturing the washing machine 10 with the fascia 20. At step 120, the washing machine 10 is manufactured and assembled with the fascia 20 as described previously. Step 120 takes place at a first location, for example, a manufacturing plant. At step 122, the washing machine 10 is transported to a second location which could be, for example, a retail outlet or a storage facility. At step 124, at least one alternative fascia is manufactured, optionally at the first location. Step 124 may occur simultaneously with step 120. Step 124 may be performed at a different location and/or at a different time to step 120. Step 124 is followed by step 126 in which the or each alternative fascia is transported to the second location. Step 126 may occur simultaneously with step 122 or at a different time. An alternative fascia is selected for the washing machine 10 at step 128. The customer generally makes this selection. After making the selection, at step 130 the fascia 20 is removed and replaced with the selected alternative fascia 150–162.

FIG. 10 shows an alternative method of manufacturing the washing machine 10. At step 120' the washing machine 10 is assembled, at a first location, without any fascia 20. The first location may be the manufacturing plant. The washing machine 10 is transported to a second location at step 122'. The second location is generally a retail outlet or a storage facility. At step 124', a plurality of alternative fascias are manufactured. Step 124' may occur at the first location, i.e. where the washing machine 10 is manufactured, and may occur simultaneously with step 120'. Alternatively, step 124' may occur at a different location to step 120' and/or at a different time. The alternative fascias are then transported to the second location 126' before, simultaneously with or after step 122'. At step 128', an alternative fascia is chosen for the washing machine 10. The retailer may choose the alternative fascias to provide a range of washing machines 10 having different appearances for display purposes. Primarily, it is the customer who selects his preferred alternative fascia from the range offered at the retail outlet. Alternatively, the selection may be made from a brochure or on an internet site. At step 130', the selected alternative fascia is assembled onto the frame 78 of the washing machine 10. The retailer generally carries out the assembly.

Modifications and variations will be apparent to a skilled reader. Means and devices for holding the fascia on the frame, other than those mentioned above, are not intended to be excluded from protection. For example, releasable snap-fittings may be provided on the fascia as an alternative to the hooks and screws. The assembly of the fascia onto the frame and/or its removal therefrom may be simplified. For example, the fascia may be manufactured with the control panel fixed in place. Further, the assembly may be changed so that the fascia could be replaced without having to remove the top cover. This would reduce the time taken to replace the fascia and would make the assembly easier. It will be appreciated that the invention is not limited to the precise details of the embodiment described above.

What is claimed is:

1. A method of manufacturing a laundry appliance comprising:

a) manufacturing and assembling, in a first location, a laundry appliance comprising an outer casing in which is mounted an apparatus for washing and/or drying laundry, the outer casing comprising a structure for receiving a fascia;

b) transporting the laundry appliance to a second location;

c) manufacturing a plurality of fascias attachable to the outer casing of the laundry appliance, the fascias differing from one another in color, material or finish;

d) transporting the fascias to the second location;

e) selecting a fascia; and f) attaching the selected fascia to the outer casing so as to select the final appearance of the otherwise complete manufactured laundry appliance in the second location.

2. A method of manufacturing a laundry appliance as claimed in claim 1, wherein steps (a) and (c) occur before step (d).

3. A method of manufacturing a laundry appliance as claimed in claim 1 or 2, wherein steps (a) and (b) occur before step (d).

4. A method of manufacturing a laundry appliance as claimed in claim 1, wherein steps (c) and (d) occur before step (a).

5. A method of manufacturing a laundry appliance as claimed in claim 1, 2 or 4, wherein steps (c) and (d) occur before step (d).

6. A method of manufacturing a laundry appliance as claimed in claim 1 or 2, wherein steps (a) and (b) occur before step (c).

7. A method of manufacturing a laundry appliance as claimed in claim 1, wherein steps (a) and (b) occur before step (b).

8. A method of manufacturing a laundry appliance as claimed in claim 1 or 2, wherein steps (b) and (d) occur simultaneously.

9. A method of manufacturing a laundry appliance as claimed in claim 1, wherein step (c) takes place at a third location different from the first and second locations.

10. A method of manufacturing a laundry appliance as claimed in claim 1, wherein the first location is a manufacturing plant.

11. A method of manufacturing a laundry appliance as claimed in claim 1, wherein the second location is a storage facility or retail outlet.

12. A method of manufacturing a laundry appliance as claimed in claim 1 or 2, wherein at least three alternative fascias are provided.

13. A method of manufacturing a laundry appliance as claimed in claim 12, wherein at least five alternative fascias are provided.

14. A method of manufacturing a laundry appliance as claimed in claim 12, wherein at least seven alternative fascias are provided.

* * * * *

UNITED STATES PATENT AND TRADEMARK OFFICE

CERTIFICATE OF CORRECTION

PATENT NO. : 6,920,676 B2
DATED : July 26, 2005
INVENTOR(S) : Nicholas G. Fitton et al.

It is certified that error appears in the above-identified patent and that said Letters Patent is hereby corrected as shown below:

Column 8,
Line 25, replace "(b)" with -- (c) --.

Signed and Sealed this

Seventeenth Day of January, 2006

JON W. DUDAS
*Director of the United States Patent and Trademark Office*